United States Patent [19]

DeYoung

[11] Patent Number: 4,768,266

[45] **Date of Patent: * Sep. 6, 1988**

[54] METHOD OF MAKING AN INK JET PRINTER TRANSDUCER ARRAY

[75] Inventor: Thomas W. DeYoung, Stormville, N.Y.

[73] Assignee: Dataproducts Corporation, Woodland Hills, Calif.

[ * ] Notice: The portion of the term of this patent subsequent to Jun. 21, 2005 has been disclaimed.

[21] Appl. No.: 902,473

[22] Filed: Aug. 29, 1986

[51] Int. Cl.[4] ..... H04R 17/00

[52] U.S. Cl. ..... 29/25.35; 346/140 PD; 156/344

[58] Field of Search ..... 29/25.35; 346/140 PD; 310/330, 328, 357, 368; 156/248, 257, 272.2, 292, 344

[56] References Cited

U.S. PATENT DOCUMENTS

| | | | |
|---|---|---|---|
| 3,192,420 | 6/1965 | Cowan | 310/358 |
| 3,596,335 | 8/1971 | Bennett | 29/25.35 |
| 3,904,274 | 9/1975 | Feinleib et al. | 310/328 |
| 4,439,780 | 3/1984 | DeYoung et al. | 346/140 PD |
| 4,572,981 | 2/1986 | Zola | 310/357 |

FOREIGN PATENT DOCUMENTS

| | | | |
|---|---|---|---|
| 178887A | 4/1986 | European Pat. Off. . | |
| 181399 | 10/1983 | Japan | 29/25.35 |

*Primary Examiner*—P. W. Echols

*Attorney, Agent, or Firm*—Woodcock Washburn Kurtz Mackiewicz & Norris

[57] ABSTRACT

A transducer array for an ink jet printing apparatus includes a plurality of discrete transducer elements, each of which are comprised of a poled ferroelectric material arranged and bonded along one face thereof to a rigid substrate by a thermoplastic cement. The opposite face of each of said transducer elements is bonded at one end to a coupling means communicating within an ink jet chamber having an ink droplet ejection orifice, and at the other end to rigid support means, a means for bonding both ends comprised of a structural-type conductive epoxy having a predetermined cure temperature. A method for fabricating such an array includes the steps of heating the bonded transducer elements at the cure temperature, but below a second predetermined temperature representative of the temperature at which the thermoplastic cement readily flows. Once the epoxy means has cured, the transducer array which is incorporated within the ink jet printing apparatus is heated to the second predetermined temperature, thereby permitting the removal of the rigid substrate and subsequent assembly operations.

4 Claims, 2 Drawing Sheets

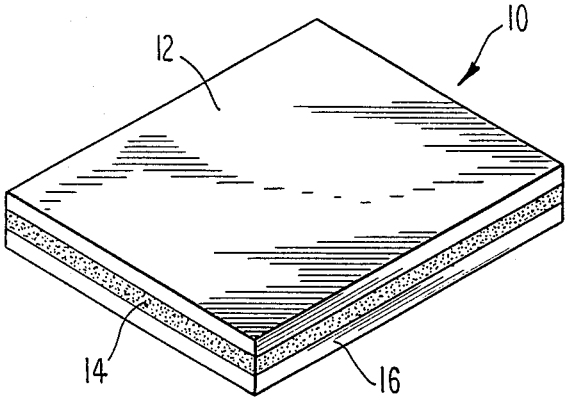
Fig. 1
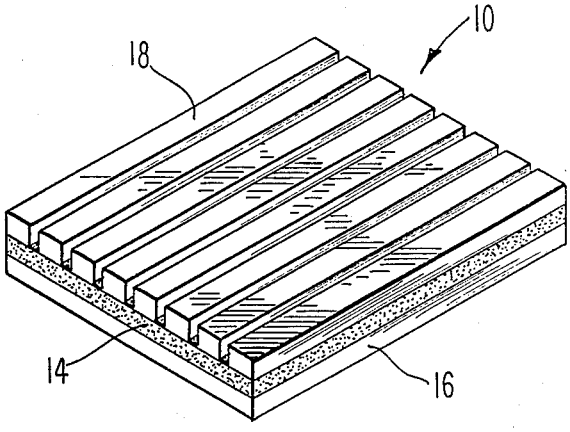
Fig. 2
Fig. 3
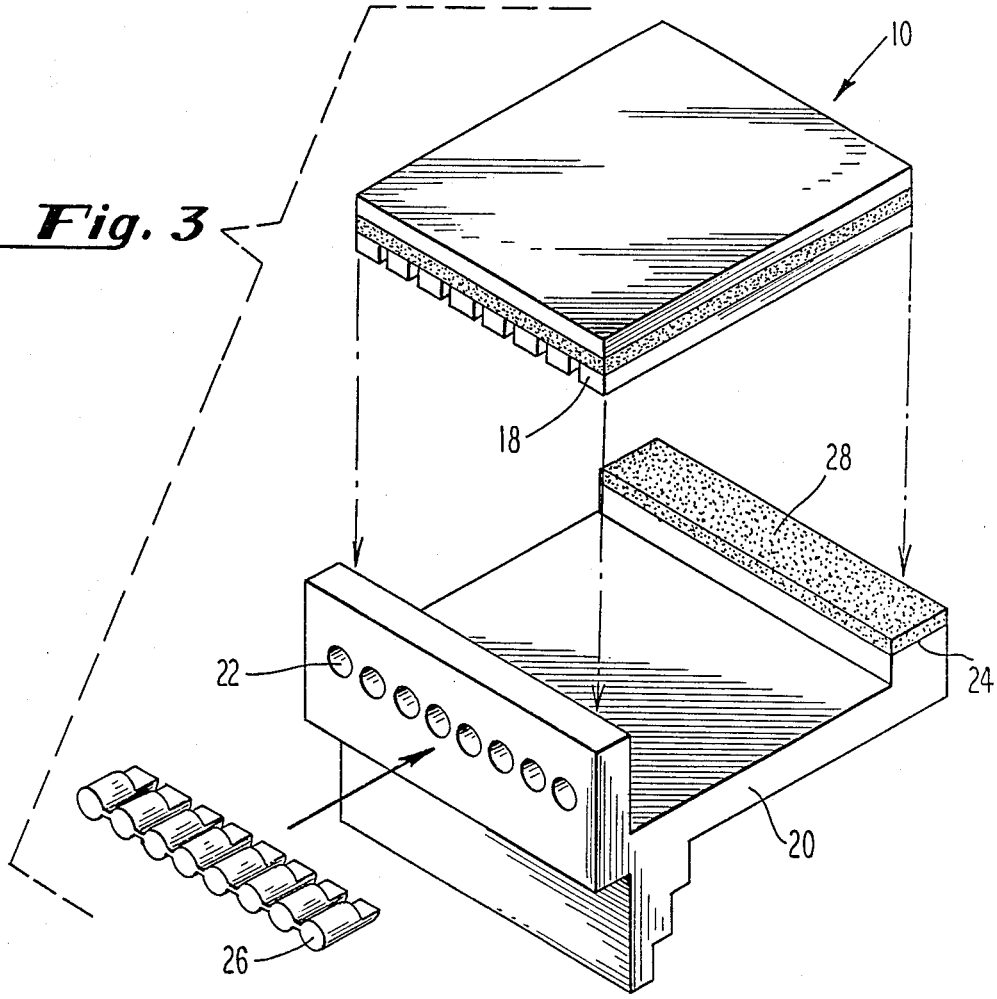

METHOD OF MAKING AN INK JET PRINTER TRANSDUCER ARRAY

BACKGROUND OF THE INVENTION

This invention relates generally to ink jet apparatus, and more specifically to a transducer array for use in a multi-jet, drop-on-demand ink jet printer.

In liquid droplet ejecting systems of the drop-on-demand type, such as impulse ink jet printers, a piezoceramic transducer is used to cause expulsion of ink as droplets from a small nozzle or jet. An array of such jets is often utilized in high-speed, high-resolution printers where, as is well-known, the printing rate and printed image resolution is dependent upon the number of jets and spacing therebetween. In general, the closer the jets are to one another, the faster the images can be produced and the higher the resulting image resolution.

One suitable such printer is described in U.S. Pat. No. 4,459,601, issued July 10, 1984 to Stuart D. Howkins, assigned to the assignee of the present invention and incorporated herein by reference. In that arrangement, an ink jet apparatus of the demand or impulse type comprises a chamber and an orifice from which droplets of ink are ejected in response to the state of energization of a transducer which communicates with the chamber through a foot forming a movable wall. The transducer expands and contracts, in a direction having at least one component extending parallel with the direction of droplet ejection through the orifice, and is elongated in such direction, the electric field resulting from the energizing voltage being applied transverse to the axis of elongation.

One problem common to all high-speed, high resolution, drop-on-demand ink jet printers occurs because the jets of an array are spaced very close to one another. That is, the response of a one jet in an array to its drive voltage can be affected by the simultaneous application of a drive voltage to another nearby jet. This can result in a phenomenon, known in the art as "mechanical cross-talk", where pressure waves are transmitted through the solid material in which the jets are formed, or in another phenomenon, known in the art as "electrical cross-talk", where relatively large drive voltages necessary for substantial displacement of transducers utilized in the prior art cause the subsequent pulsing of an inappropriate jet.

While the risk of electrical cross-talk between ink jets in an array utilizing the teachings of U.S. Pat. No. 4,459,601 as discussed above will be minimized, the risk of mechanical cross-talk remains. One approach which alleviates this problem, however, is discussed in U.S. Pat. No. 4,439,780, issued Mar. 27, 1984 to Thomas W. DeYoung and Viacheslav B. Maltsev, assigned to the assignee of the present invention and incorporated herein by reference. In that arrangement, an ink jet array comprises a plurality of elongated transducers coupled to a plurality of ink jet chambers, the transducers being supported only at their longitudinal extremities. The support at the extremity remote from the chamber is provided such that no longitudinal motion along the axis of elongation of the transducers occurs, while the support at the other extremity includes bearings which substantially preclude lateral movement of the transducers transverse to their axis of elongation but permit the longitudinal movement thereof along the axis, thus minimizing mechanical cross-talk between jets within the array.

Other characteristic problems which are encountered in the implementation of high-speed, high-resolution impulse ink jet printers do not impact so much upon their operation, but indeed impact upon their fabrication. For example, the relatively small sizes of transducer elements used in densely packed arrays make them difficult to handle. A unitary transducer array is, therefor, preferred.

One early approach towards the resolution of the above-described problem is disclosed in U.S. Pat. No. 4,072,959, which issued to Rune Elmqvist. As discussed therein, a recorder operating with drops of liquid includes a comb-shaped piezoelectric transducer arranged such that individual teeth of the comb are associated respectively to a densely-packed array of ink jet chambers. In this connection, it will be appreciated that the chambers are quite small so as to produce a high Helmholtz frequency as compared with the longitudinal resonant frequency of the individual transducers. Such a relationship can be undesirable since it is difficult to damp the longitudinal resonant frequency.

As is also discussed in the Elmqvist patent, each of the transducers is immersed in a common reservoir such that energization of one transducer associated with one chamber may produce cross-talk with respect to an adjacent chamber or chambers. In other words, there is no fluidic isolation from chamber to chamber between the various transducers, or more accurately, segments of the common transducer. In addition to such cross-talk problems, the construction shown in the Elmqvist patent poses a requirement for a non-conductive ink.

Similar such attempts to ease the manufacture of impulse-type arrays which reduce mechanical cross-talk between individual jets are disclosed in U.S. Pat. No. 4,389,658, issued to Theodore P. Perna et al, and U.S. Pat. No. 4,446,469, issued solely to Perna. In accordance with the '658 patent, a pulsed liquid droplet ejecting apparatus array comprises a plurality of rectangular piezoelectric transducers which are arranged abaxially over ink-containing chambers, an edge of each transducer being fixed against a reaction block. An improved method for rigidly mounting the piezoelectric transducers to the reaction block, comprising a cross-talk reducing member installed between adjacent transducers, is taught by U.S. Pat. No. 4,446,469. The U.S. Pat. No. 4,446,469 cross-talk reducing member is made up of two steel plates held in spaced relationship by adhesive, forming a void therebetween to reduce transmittal of pressure waves from one transducer to another. Both of these patents, nevertheless, require tedious picking and placing operations during their fabrication.

One other approach to the simplification of assembly operations in the manufacture of ink jet printers is disclosed in U.S. Pat. No. 4,409,601, issued to Kenth Nilsson et al, and U.S. Pat. No. 4,539,575, issued solely to Nilsson. In accordance with the '601 patent, a mosaic recorder for ejecting liquid droplets has nozzles arranged in rows in front of a recording medium, each nozzle having a piezoelectric transducer associated therewith. The individual transducers are comprised of bilaminar teeth of a comb-like piezoplate consisting of a piezoceramic and a carrier material, the piezoplate having a base by which the transducers are attached to a recording head. For reducing the mechanical coupling between the transducer teeth so that transmission of coupling forces from an activated transducer tooth to the adjacent transducer teeth is substantially eliminated, the ceramic material between the teeth in the area of the comb base is removed so as to provide a gap between adjacent teeth. While the unattached ends of each transducer in the '601 patent are arranged to provide flexural vibration to excite the respective nozzle, the '575 patent teaches the use of individual, bilaminar transducer elements which are connected at both ends via cross pieces. Upon application of an electrical potential, the excited transducer lifts away from the jet plate in a quasi-arcuate fashion, subsequently returning to a flat configuration thereby ejecting a drop through the jet orifice. While perhaps satisfactory for many applications, neither of the patents described immediately above solve the many problems associated with manufacturing transducer elements for incorporation into impulse ink jet printers.

SUMMARY OF THE INVENTION

Accordingly, it is general purpose and object of the present invention to provide a transducer array for use in an ink jet printing apparatus. More specifically, it is an object of this invention to provide an ink jet printer which is easily fabricated, capable of producing a high-resolution image at high rates of speed, and which minimizes cross-talk between jets.

Another object of this invention is to provide an improved method for producing a transducer array which may be easily assembled within an ink jet printer.

Still another object of this invention is to provide an ink jet printer with a minimum of parts.

Briefly, these and other objects of the present invention are accomplished by a transducer array which is produced in unitized fashion for ready assembly within an ink jet apparatus. The ink jet apparatus, the preferred embodiment of the invention, includes a plurality of variable volume chambers, each of which is coupled to a respective element of the transducer array for the ejection of ink through an associated orifice or jet.

In accordance with one important aspect of this invention, a monolithic slab of piezoelectric material, for example lead zirconate titanate (PZT) is laminated to a rigid substrate such as glass by a selected thermoplastic cement. This lamina is then sized according to the desired number and dimensions of individual transducer elements and element spacing, and is subsequently diced to produce those elements. After such sizing and dicing, the lamina is positioned PZT side down with one end thereof being bonded by a structural-type electrically conductive epoxy to a shelf formed in the printer head, thereby creating a ground plane for the transducers. The other end is then operatively coupled to the variable volume chambers, and the resulting assembly is placed within an oven to cure.

In accordance with yet another important aspect of the invention, the thermoplastic cement and structural-type electrically conductive epoxy are particularly selected in order to permit their effective interaction. When the assembly is placed in the oven, the oven's temperature is set to a temperature which both promotes the curing of the structural-type electrically conductive epoxy and precludes the melting of the thermoplastic cement. Once the structural-type electrically conductive epoxy has cured, the oven's temperature is elevated to a point at which the thermoplastic cement will readily flow, thus facilitating the removal of the rigid substrate. Accordingly, the selected thermoplastic cement is preferably chemically compatible with the selected structural-type electrically conductive epoxy, and should be readily soluble in standard cleaning solutions to promote easy assembly. Thereafter, the transducer elements can be electrically coupled by conventional means.

Other objects, advantages and novel features of this invention will become apparent from the following detailed description of a preferred embodiment when considered in conjunction with the accompanying drawings wherein:

BRIEF DESCRIPTION OF THE DRAWINGS

FIG. 1 shows a lamina of piezoelectric material which is bonded to a rigid substrate;

FIG. 2 shows the lamina of FIG. 1 after its sizing and dicing;

FIG. 3 illustrates the exploded assembly of the sized and diced lamina of FIG. 2 into a printer head;

DETAILED DESCRIPTION OF A PREFERRED EMBODIMENT

Figure 4:
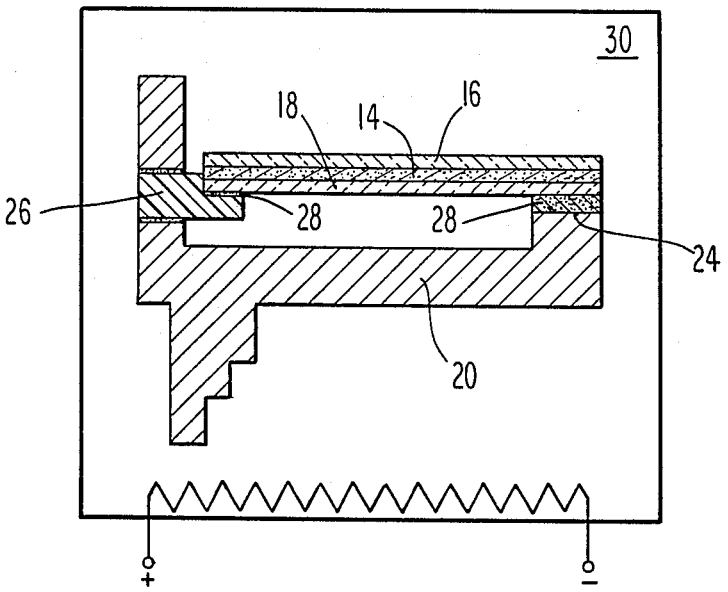
FIG. 4 illustrates in cross section the assembly of FIG. 3 while it is curing within an oven.

Referring now to the drawings, wherein like characters designate like or corresponding parts throughout the several views, there is shown in FIG. 1 a lamina 10 having a first layer 12 of piezoelectric material which is bonded by a layer 14 of thermoplastic cement to a second layer 16 comprising a rigid substrate. The piezoelectric layer 12 comprises a conventionally poled ferroelectric ceramic, such as lead zirconate titanate (PZT) which has been exposed to an original DC polarizing field. As is well known in the art, the polar axis of such piezoelectric ceramics is parallel to the original DC polarizing field. It will be appreciated from the following discussion, therefor, that the piezoelectric layer 12 includes a negative or ground plane which, according to the invention, faces out when incorporated within the lamina 10.

The lamina 10, as shown in FIG. 2, is then sized and diced to produce an array of transducer elements 18. In accordance with an important aspect of this invention, the sizing step determines the outside dimensions of the transducer array; that is, the overall length and width of the lamina 10 is determined by the desired number and length of the transducer elements 18. Thereafter, the dicing step produces the individual transducer elements 18 and insures a proper element width and spacing therebetween within the array.

Referring now to FIG. 3, the sized and diced lamina 10 is shown ready for positioning within a printer head 20. The printer head 20 includes at one end thereof a plurality of chambers 22, and at the other end a shelf portion 24 upon which the lamina 10 will be supported. In a preferred embodiment of the invention, a ganged array of transducer feet 26 as described in copending application Ser. No. 901,886, filed Aug. 29, 1986 is inserted through the chambers 22 thereby providing a second point of attachment for each of the transducer elements 18. A layer of structural-type electrically conductive epoxy 28 is applied to the shelf 24 and each of the feet 26. The lamina 10 is then attached to the printer head 20 such that each of the transducer elements 18 is aligned with a respective foot 26 and supported by the shelf 24. The epoxy 28 may then be cured in an oven 30 as shown in FIG. 4.

In accordance with another important aspect of the invention, the thermoplastic cement 14 and epoxy 28 must be carefully selected to ensure their effective interaction. For example, the thermoplastic cement 14 must provide a tenacious bond between the PZT layer 12 and the rigid substrate 16 in order to effectively size and dice the lamina 10 for the production of uniform transducer elements 18. Moreover, the thermoplastic cement 14 must be capable of withstanding temperatures required to cure the epoxy 28 without melting, must itself be chemically compatible with the epoxy 28, and must be readily soluble in standard cleaning solutions. One suitable such thermoplastic cement 14 is Struers Lakeside 70 C cement, a registered trademark of H. Courtright & Co., Chicago, Ill. A suitably compatible epoxy 28 which was used in a preferred embodiment of the invention is EPO-TEK H20E, a two component, silver filled epoxy produced by Epoxy Technology, Inc., Billerica, Mass.

Figure 5:
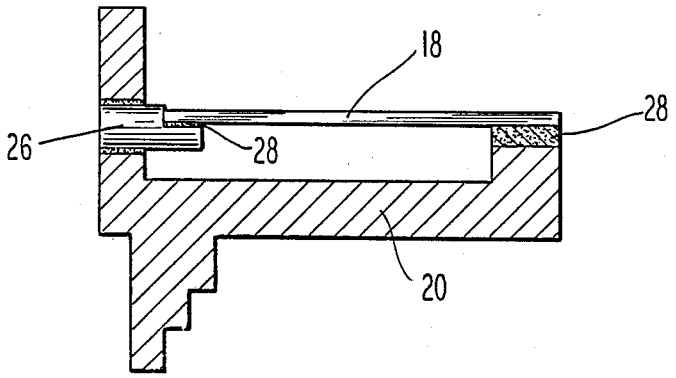
FIG. 5 shows a cutaway view of the assembly after removal of its rigid substrate.

Referring now to FIG. 4, it will be appreciated that the temperature of the oven 30 which is selected to cure the epoxy 28 must also prevent the melting of the thermoplastic cement 14 once the epoxy 28 has cured. The temperature of the oven 30 is elevated to a point at which the thermoplastic cement 14 will readily flow, thereby freeing the rigid substrate 16 from the array of transducer elements 18 as shown in FIG. 5. After the rigid substrate 16 is removed, the transducers 18 and printer head 20 are cleaned using such standard solvents as alcohol, acetone, or a solution of borax in water.

Figure 6:
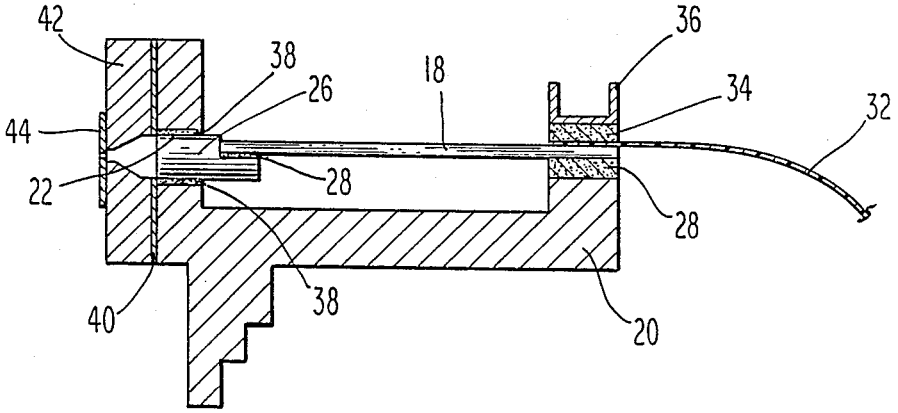
FIG. 6 shows a cutaway view of an ink jet printer which incorporates a transducer array according to the present invention.

Upon cleaning, subsequent assembly operations may be carried out as shown in FIG. 6. In accordance with one important aspect of the invention, the transducers 18 are elongated in the direction of expansion and contraction and the electric field resulting from an energizing voltage is applied transverse to the axis of elongation. This is particularly desirable since displacement can be made larger simply by increasing the length of the transducers 18, and an increase in the length of the transducers 18 will not result in any decrease in density of an array formed thereby. Moreover, large displacements can be achieved without applying large electrical voltages which could result in electrical cross-talk. It is desirable, however, to limit the length of the transducers 18 so as to limit undesirable weight and flexural motion which can result when the transducer becomes too long and thin.

In accordance with another important aspect of the invention, the upper surface or signal plane of each transducer 18 is connected to a lead 32, such as a flexible electrical cable having individual contacts with each of the respective transducer elements 18, which is held in place without the necessity of solder by an elastomeric compound 34 and its associated retainer 36. This configuration results in effective electrical shielding, and hence minimizes electrical cross-talk. The polarity of the signal plane is such that the electrical field which is applied through the lead 32 is in the same direction as the polarization of the transducer 18. This results in contraction of the transducer 18 in response to the energization of the signal plane and expansion in response to de-energization thereof.

The feet 26 are subsequently separated, as is more fully described in copending application Ser. No. 901,886, filed Aug. 29, 1986, and are potted within the chambers 22 by an elastomeric potting compound 38. Fluidic supply and ejection means, such as a restrictor plate 40, a chamber plate 42, and an orifice plate 44, may be attached to complete the assembly of an exemplary ink jet printer.

As utilized herein, the term elongated is intended to indicate that the length is greater than the width. In other words, the axis of elongation as utilized herein extends along the length which is greater than the transverse dimension across which the electric field is applied. Moreover, it will be appreciated that the particular transducer may be elongated in another direction which might be referred to as the depth and the overall depth may be greater than the length. It will, therefore, be understood that the term elongation is a relative term. Moreover, it will be understood that the transducer will expand and contract in other directions in addition to along the axis of elongation but such expansion and contraction is not of concern because it is not in the direction of coupling. In the embodiments shown herein, the axis of coupling is the axis of elongation.

Although particular embodiments of the invention have been shown and described, other embodiments will occur to those of ordinary skill in the art which fall within the true spirit and scope of the appended claims.

What is claimed is:

1. A method of fabricating a multi-nozzle ink jet apparatus, comprising the steps of:

forming a substantial portion of an array of ink jet chambers, each of said ink jet chambers including an ink droplet ejection orifice and a substantial opening;

polarizing a slab of piezoelectric material of predetermined thickness, said polarizing step including the application of an electric field across the thickness of said slab to produce a positive pole face and a ground plane face;

laminating said positive pole face to a rigid substrate;

dicing said slab to form a plurality of discrete transducer elements;

coupling each of said transducer elements to a respective one of said substantial openings such that the volume of the ink jet chambers formed thereby is varied as a function of a state of energization of said transducer elements; and delaminating said rigid substrate from said transducer elements.

2. A method according to claim 1, wherein said laminating step comprises the steps of:

heating said rigid substrate to a first predetermined temperature;

applying a thermoplastic means to said heated substrate;

bonding said slab of piezoelectric material to said rigid substrate thereby forming a uniform thermoplastic layer therebetween; and cooling said rigid substrate with said slab of piezoelectric material bonded thereto below said first predetermined temperature.

3. A method according to claim 2, wherein said coupling step comprises the steps of:

supporting said transducer elements, each at one end thereof remote from said chambers upon a rigid means;

bonding said end of said transducer elements to said rigid means by epoxy means; and curing said epoxy means by heating said transducer elements bonded to and supported by said rigid means to a second predetermined temperature below said first predetermined temperature.

4. A method according to claim 3, wherein said delaminating step comprises the steps of:

heating said transducer elements bonded to said rigid substrate to a third predetermined temperature between said first and second predetermined temperatures; and removing said rigid substrate and said thermoplastic means.

* * * * *